US010290406B2

(12) United States Patent
Chiriac et al.

(10) Patent No.: US 10,290,406 B2
(45) Date of Patent: May 14, 2019

(54) METALLIC MAGNETIC MATERIAL WITH CONTROLLED CURIE TEMPERATURE AND PROCESSES FOR PREPARING THE SAME

(71) Applicant: INSTITUTUL NATIONAL DE CERCETARE DEZVOLTARE PENTRU FIZICĂ TEHNICĂ IAŞI, Iaşi (RO)

(72) Inventors: Horia Chiriac, Iaşi (RO); Nicoleta Lupu, Iaşi (RO)

(73) Assignee: INSTITUTUL NATIONAL DE CERCETARE DEZVOLTARE PENTRU FIZICA TEHNICA IASI, Iasi (RO)

( * ) Notice: Subject to any disclaimer, the term of this patent is extended or adjusted under 35 U.S.C. 154(b) by 190 days.

(21) Appl. No.: 15/101,397

(22) PCT Filed: Dec. 3, 2014

(86) PCT No.: PCT/RO2014/000032

§ 371 (c)(1),
(2) Date: Jun. 2, 2016

(87) PCT Pub. No.: WO2015/171008

PCT Pub. Date: Nov. 12, 2015

(65) Prior Publication Data

US 2016/0300647 A1 Oct. 13, 2016

(30) Foreign Application Priority Data

Dec. 3, 2013 (RO) ..... 2013 00949

(51) Int. Cl.

| | |
|---|---|
| ***H01F 1/03*** | (2006.01) |
| ***H01F 1/153*** | (2006.01) |
| ***C22C 33/00*** | (2006.01) |
| ***C22C 38/00*** | (2006.01) |
| ***C22C 38/04*** | (2006.01) |
| ***C22C 38/12*** | (2006.01) |
| ***C22C 38/14*** | (2006.01) |
| ***C22C 45/02*** | (2006.01) |
| ***B22F 1/00*** | (2006.01) |
| ***B22F 9/08*** | (2006.01) |
| ***C22C 33/02*** | (2006.01) |
| *B22F 9/04* | (2006.01) |

(52) U.S. Cl.

CPC ..... *H01F 1/0306* (2013.01); *B22F 1/004* (2013.01); *B22F 1/0025* (2013.01); *B22F 9/08* (2013.01); *C22C 33/003* (2013.01); *C22C 33/0278* (2013.01); *C22C 38/002* (2013.01); *C22C 38/04* (2013.01); *C22C 38/12* (2013.01); *C22C 38/14* (2013.01); *C22C 45/02* (2013.01); *H01F 1/15308* (2013.01); *B22F 2009/043* (2013.01); *B22F 2009/048* (2013.01); *B22F 2998/10* (2013.01); *C22C 2202/02* (2013.01)

(58) Field of Classification Search

CPC .. B22F 2009/048; B22F 2998/10; B22F 9/08; B22F 1/0025; B22F 1/004; B22F 2009/043; C22C 2202/02; C22C 33/003; C22C 33/0278; C22C 38/002; C22C 38/04; C22C 38/12; C22C 38/14; C22C 45/02; H01F 1/0306; H01F 1/15308

See application file for complete search history.

(56) References Cited

U.S. PATENT DOCUMENTS

| | | | | |
|---|---|---|---|---|
| 4,225,339 | A * | 9/1980 | Inomata | C22C 45/008 148/304 |
| 4,822,451 | A | 4/1989 | Ouderkirk et al. | |
| 5,390,072 | A | 2/1995 | Anderson et al. | |
| 5,506,059 | A | 4/1996 | Robbins et al. | |
| 5,976,274 | A | 11/1999 | Inoue et al. | |
| 6,232,466 | B1 | 5/2001 | Daimon et al. | |
| 6,284,061 | B1 | 9/2001 | Inoue et al. | |
| 7,697,664 | B2 | 4/2010 | Harding | |

(Continued)

FOREIGN PATENT DOCUMENTS

| | | |
|---|---|---|
| DE | 28 55 858 | 7/1979 |
| DE | 198 02 349 | 7/1998 |

OTHER PUBLICATIONS

Microstructural investigation of Fe—Ti—B—Nb magnetic glassy metallic ribbons (Year: 2015).*

Microstructural investigation of Fe—Mn—B—Nb glassy ribbons (Year: 2016).*

International Search Report dated Feb. 22, 2016, issued in PCT/RO2014/000032.

Nicoleta Lupu et at., Development of Fe Nb Cr B Glassy Alloys with Low Curie Temperature and Enhanced Soft Magnetic Properties, IEEE Transactions on Magnetics, IEEE Service Center, New York, NY, US, v.47, n.10, Oct. 1, 2011, pp. 3791-379.

(Continued)

*Primary Examiner* — Jenny R Wu

(74) *Attorney, Agent, or Firm* — Hershkovitz & Associates, PLLC; Abe Hershkovitz

(57) ABSTRACT

The invention relates to a metallic magnetic material with biocompatible elements (Ti, Ta or Mn), with glassy quasi-amorphous structure and controlled Curie temperature, and the processes for preparing the same. The hereby material has its composition expressed in atomic percent: Fe=59 . . . 67%, Nb=0.1 . . . 1%, B=20%, biocompatible material (Ti, Ta or Mn)=12 . . . 20%), Curie temperature within the interval 0 . . . 70° C., saturation magnetic induction of 0.05 . . . 1.1 T and strong magnetic response when introduced in a high frequency magnetic field. The processes used to obtain this material directly under the form of ribbons, glass-coated micro/nanowires or nano/micropowders consist in rapid quenching of the mixtures with previously mentioned compositions under extremely rigorous controlled conditions, in high vacuum of minimum $10^{-4}$ mbars or in controlled helium or argon atmosphere in order to avoid oxidation.

6 Claims, 7 Drawing Sheets

(56) References Cited

U.S. PATENT DOCUMENTS

Figure 1:
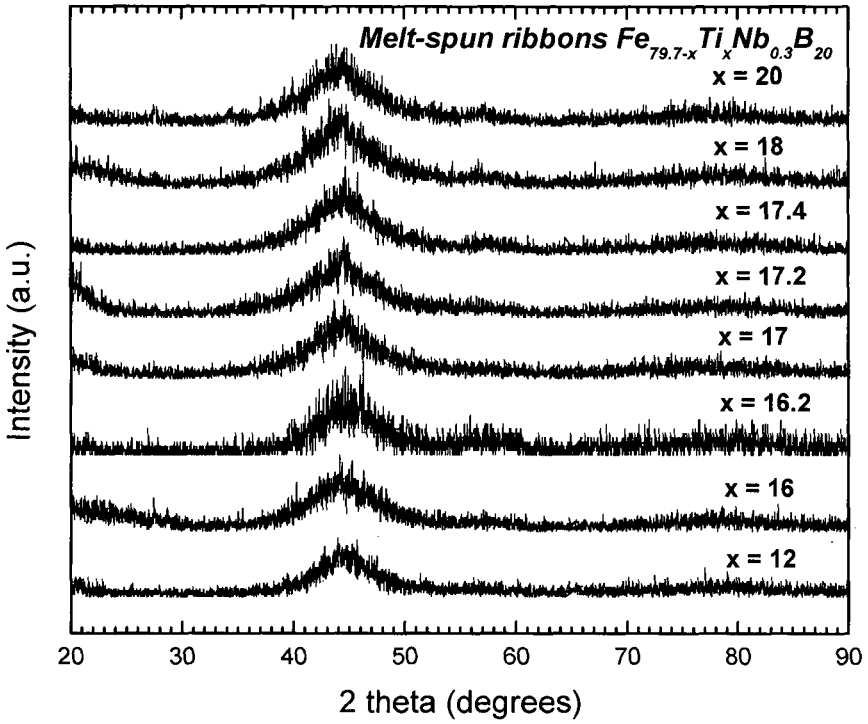

| | | | |
|---|---|---|---|
| 7,842,140 | B2 | 11/2010 | Kanekiyo et al. |
| 8,767,453 | B2 | 7/2014 | Dieny et al. |
| 8,947,916 | B2 | 2/2015 | Dieny et al. |
| 9,576,635 | B2 | 2/2017 | Dieny |

OTHER PUBLICATIONS

Lins S. T. et al., Formation and Properties of Amorphous (Fe1—xNbx) IB100-I, Database Inspec [online], The Institution of Electric Engineers, Stenage, GB; Apr. 1988.
R.M. Bozorth, Ferromagnetism, Wiley-IEEE Press, 1993.
T. Kaneyoshi, Introduction to Amorphous Magnets, World Scientific Publishing, 1992.
V. Zhukova, et al, Journal of Magnetism and Magnetic Materials, 249 (1-2) (2002).
V. Zhukova, et al., Sensor and Actuators B, 126(2007), p. 318-323.
J. Stergar, et al., Journal of Allows and Compounds, 756(2013), pp. 220-226.
D.S. Choi, et al., Journal of Nanoscience and Nanotechnology, 8(5) (2008), pp. 2323-2327.
N. Lupu, et al., IEEE Transactions on Magnetics, 47(10) (2011), pp. 3791-3794.
G. G. Rusu, "Structural, electronic transport and optical properties of Zn-doped CdTe thin films," Journal of Optoelectronics and Advanced Materials 8 (3), Jun. 2006, pp. 931-935.
M. L. Roukes, "Nanoelectromechanical Systems," Technical Digest of the 2000 Solid-State Sensor and Actuator Workshop, Hilton Head Isl., SC, Jun. 4-8, 2000, pp. 1-10.
E. Arslan, F. Bulbul and I. Efeoglu, "The Structural and Tribological Properties of MoS2—Ti Composite Solid Lubricants," Tribology Transactions, 47, 2004, pp. 218-226.
Qiang Wang, Hui Huang Tay, Ziyi Zhong, Jizhong Luo and Armando Borgna, "Synthesis of high-temperature CO2 adsorbents from organo-layered double hydroxides with markedly improved CO2 capture capacity," Energy Environmental Science, 5, 7526, 2012.
V. M. Longo et al., "Photoluminescence in quasi-amorphous Pb0.8X0.2Zr0.53Ti0.4703 (X= Ca, Sr and Ba) powders: An optical and structural study," Elsevier Chemical Physics Letters 475, 2009, pp. 96-100.
O. A. Ageev et al., "Au—$TiB_x$-n-6H—SiC Schottky Barrier Diodes: Specific Features of Charge Transport in Rectifying and Nonrectifying Contacts," Semiconductors, vol. 43, No. 7, 2009, pp. 865-871, Pleiades Publishing Ltd, 2009.
Keunkyu Song et al., "Solution processed invisible all-oxide thin film transistors," J. Mater. Chem, 2009, 19, pp. 8881-8886.
Corentin Le Guillou et al., "Nanodiamond nucleation below 2273 K at 15 GPa from carbons with different structural organizations," Elsevier, Dec. 15, 2006, Carbon 45, 2007, pp. 636-648.
M. Zaharescu et al., "Correlation between the method of preparation and the properties of sol-gel HfO2 thin films," Journal of Nano-Crystalline Solids 354, 2008, pp. 409-415.
Hideo Kayano, "Material Development for Nuclear Fusion and Energy Development Using Actinoids," Science Reports of the Research Institutes, Tohoku University, Ser. A, Physics, chemistry and metallurgy, vol. 40, 1994, pp. 105-109.
Keunkyu Song et al., "Low-temperature soluble InZnO thin film transistors by microwave annealing," published by Journal of Crystal Growth 326, 2011, pp. 23-27.
A. D. Pogrebnjak et al., "Multicomponent (Ti—Zr—Hf—V—Nb)N Nanostructure Coatings Fabrication, High Hardness, and Wear Resistance," Proceedings of the IX International Conference ION 2012, Kazimierz Dolny, Poland, Jun. 25-28, 2012, Acta Physica Polonica A, vol. 123, No. 5, 2013, pp. 816-818.
Vera Lyahovitskaya et al., "Pyroelectricity in Highly Stressed Quasi-Amorphous Thin Films," Advanced Materials, 15, No. 21, Nov. 4, 2003, Wiley—VCH Verlag GmbH & Co. KGaA, Weinheim, 2003, pp. 1826-1828.
J. Moser and F. Levy, "Crystal reorientation and wear mechanism in MoS2 lubricating thin films investigated by TEM," J. Mater. Res. vol. 8, No. 1, Jan. 1993, pp. 206-213.
Dengtehg Ge at al., "Spray coating of superhydrophobic and angle-independent coloured films," published by Chem. Commun., 50, 2014 pp. 2469-2472.
Xiluan Wang, "Solution-processable graphene nanomeshes with controlled pore structures," Scientific Reports, 3:1996/srep01996, 1996, pp. 1-5.
W. Paatsch, "Investigation of passive electrodes using modulation spectroscopy and photopotential measurements," Journal de Physique Colloques, 38 (C5), 1977, pp. C5-151-C5-155.
Marta Gilbert et al., "Self-Organization of Heteroepitaxial CeO2 Nanodots Grown from Chemical Solutions," Adv. Mater., 19, 2007, pp. 3937-3942.
J.-L. Brousseau et al., "Electrical properties and topography of SnO2 thin films prepared by reactive sputtering," Applied Surface Science 108, 1997, pp. 351-358.
V. Pralong et al., "Reversible lithium uptake by CoP3 at low potential: role of the anion," Electrochemistry Communications 4, 2002, pp. 516-520.
M. Gnanavel et al., "Optics of Quasiparticle Phase Transitions in Nanostructured Ag Thin Films," Thin Solid Films, 2008, pp. 1-14.
A. C. Fernandes et al., "Property change in multifunctional TiCxOy thin films: Effect of the O/Ti ratio," Thin Solid Films 515, 2006, pp. 866-871.
N. M. Sanchez-Padilla et al., "Fast synthesis and electrocatalytic activity of M@Pt (M = Ru, Fe3O4, Pd) core-shell nanostructures for the oxidation of ethanol and methanol," International Journal of Hydrogen Energy 38, 2013, pp. 12681-12688.
Brian D. Adams et al., "Current density dependence of peroxide formation in the Li—O2 battery and its effect on charge," Energy & Environmental Science, 2013, 6, pp. 1772-1778.
P. Suchismita Behera et al., "Study of quasi-amorphous to nanocrystalline phase transition in thermally evaporated CuInS2 thin films," J. Mater. Res., vol. 29, No. 4, Feb. 28, 2014, pp. 542-555.
Alexander Gavriliuc, "Hydrogen Energy for Beginners," Taylor and Francis Group 2013, p. 256.
J. Simon and J. J. Andre, "Molecular Semiconductors Photoelectrical Properties and Solar Cells," published by Springer-Verlag Berlin Heidelberg 1985, pp. 22-23.
Bharat Bhushan, "Nanotribology and Nanomechanics an Introduction," Springer-Verlag Berlin Heidelberg 2008, pp. 855 and 893.
N. Bhatnagar and T.S. Srivatsan, "Processing and Fabrication of Advanced Materials—XVII vol. II," IK International Publishing House Pvt. Ltd., 2009, p. 634.
R. Ekwal Sah et al., "Silicon Nitride, Silicon Dioxide and Emerging Dielectrics 10," The Electrochemical Society, 2009, p. 481.
Edward M. Purcell, "Electricity and Magnetism Berkeley Physics Course—vol. 2," second edition, McGraw-Hill Inc., 1985, pp. 418 and 439.
"Electromechanical Medium-Frequency Generator," The Great Soviet Encyclopedia, 3rd Edition, 1970-1979.

* cited by examiner

METALLIC MAGNETIC MATERIAL WITH CONTROLLED CURIE TEMPERATURE AND PROCESSES FOR PREPARING THE SAME

DESCRIPTION OF THE INVENTION

The invention relates to a Fe—Nb—B-type metallic magnetic material with addition of biocompatible material (Ti, Ta or Mn) with "glassy" quasi-amorphous structure and controlled Curie temperature, with applications in the realization of (bio)medical sensors, and especially in inducing controlled hyperthermia, and to processes for preparing the same in various uni- or bi-dimensional shapes.

It is well-known that the ferromagnetic materials have specific magnetic properties at temperatures smaller that the transition temperature called "Curie temperature". These specific magnetic properties disappear at temperatures above Curie temperature, denoted by $T_C$. The temperature of the transition from the ferromagnetic state (magnetic order) to paramagnetic state (magnetic disorder) is an intrinsic parameter of the material, which depends on its composition and preparation process, as well as on the subsequent thermal treatments applied to the corresponding material.

It is known that the Curie temperature of the transition metals Fe, Co and Ni is much higher than the environmental temperature ($T_{C,Fe}$=770° C.; $T_{C,Co}$=1100° C.; $T_{C,Ni}$=358° C.). It is also known that the alloys which contain Fe, Co and/or Ni have the temperature of transition from the ferromagnetic to the paramagnetic state within a wide range of values (from negative values to over 1000° C.), depending on their composition, thermal history and crystalline structure [1].

It is known that the Curie temperature of the transition metal-metalloid (MT-M, where MT=Fe, Co, Ni, and M=B, P, C, Si, Al) amorphous alloys, obtained by rapid quenching from the melt as ribbons, conventional wires or thin layers is always smaller than the Curie temperature of the pure transition metals, yet the values are high enough as compared to the ambient temperature, as they range between 120 . . . 600° C. [2]. It is also known that the glass-coated amorphous microwires which contain Fe and/or Co, obtained through rapid solidification processes with metallic core diameters of 1 . . . 30 μm, have Curie temperatures of 300 . . . 400° C. [3]. The addition of Cr to the composition of the Co—Fe—Si—B glass-coated microwires results in a decrease of the Curie temperature by up to 75° C. [4].

These amorphous materials, irrespective of their shape and the fabrication method, have the disadvantage that they have high $T_C$ values and cannot be used in applications which require transition temperatures ranging between 20 and 50° C., as for instance in magnetic hyperthermia or for certain sensors used in connection with the systems for human body temperature evaluation.

Reference [5] describes a materials based on Ni—Cu with $T_C$=43° C. and obtained as nanopowder through a very complex chemical process. Even if this material seems to have a $T_C$ adequate at least for use in hyperthermia, it still has some shortcomings:

- its Curie temperature cannot be varied depending on the final application;
- it can only be obtained as nanopowder through a very complex chemical process;
- the nanopowders exhibit a superparamagnetic behavior and their magnetization is small, of only 2.5 emu/g, which makes difficult their heating in alternative current, as is the case of magnetic hyperthermia;

- it contains Ni, which can induce allergies and generate biocompatibility problems.

There have also been attempts to use the Ni nanowires in the hyperthermia process, as presented in reference [6]. Even if it was established that the radiofrequency heating of the Ni nanowires placed in contact with cancer cells produced their death, this material has certain major shortcomings:

- the Curie temperature of Ni being of about 360° C., one can not rigorously control the temperature of the body subjected to magnetic hyperthermia;
- Ni can induce allergies and generate biocompatibility problems.

Reference [7] presents data about ribbons with thickness of 20 . . . 40 μm and glass-coated microwires with the metallic core diameter of 6.5 . . . 26 μm and glass coat thickness under 20 μm, obtained through rapid quenching from the melt, with nominal composition $Fe_{67.7}Nb_{0.3}Cr_{12}B_{20}$, presenting a quasi-amorphous structure which permits to obtain low magnetic transition temperatures, within the interval 35 . . . 45° C., depending on the sample shape. This material is useful for some applications, hyperthermia included. Its main shortcoming consists in its Cr content that can generate some biocompatibility problems and therefore restricts the medical applications which imply direct contact with the cells.

The technical problem, which the invention can solve, consists in producing a metallic magnetic material of Fe—Nb—B type with addition of biocompatible elements (Ti, Ta or Mn), with glassy quasi-amorphous structure and controlled Curie temperature, for applications in (bio)medical sensors and hyperthermia, and in the realization of certain processes for preparing the same in various uni- and two-dimensional shapes.

The hereby Fe—Nb—B-type metallic magnetic material with biocompatible elements solves this technical problem and removes the shortcomings of other known materials presented above, given that:

1. it has the composition with the following atomic concentrations Fe=59 . . . 67%; Nb=0.1 . . . 1%, B=20%, biocompatible material (Ti, Ta or Mn)=12 . . . 20%;
2. it is characterized by a glassy quasi-amorphous structure, which confers special magnetic characteristics, inclusively Curie temperatures ranging between 0 and 70° C.;
3. the biocompatible elements (Ti, Ta or Mn) which it contains provide its biocompatibility and the possibility to be used in medical applications, inclusively those which imply direct contact with the cells;
4. it has high magnetic permeability and susceptibility near the magnetic transition temperature ($T_C$), which makes it useful for sensors based on the magnetic permeability variation, as well as in hyperthermia applications;
5. it can be obtained directly as ribbons, glass-coated micro/nanowires or nano/micropowders;
6. the magnetic transition temperature ($T_C$) can be accurately modified by choosing the Ti, Ta or Mn content in the material accordingly;
7. it has a magnetic saturation induction of 0.05 . . . 1.1 T, depending on Ti, Ta or Mn content, which determines a strong magnetic response when introduced in a high frequency alternative magnetic field.

Procedure 1 to produce the Fe—Ni—B metallic magnetic material with biocompatible elements, shaped as magnetic ribbons, through rapid quenching from the melt according to the invention, consists in that the metallic mix: Fe=59 . . . 67 at. %, Nb=0.1 . . . 1 at. %, B=20 at. %, and biocompatible material (Ti, Ta or Mn)=12 . . . 20 at. % is melt in a quartz tube, closed at the bottom, placed in a vacuum chamber, after which pieces of the alloy weighing 3 . . . 4 g each are extracted from the melted alloy by means of a special system consisting of several quartz tubes, in order to provide a good homogeneity of the alloy and the adequate shape such that to be taken up in the amorphizing crucible consisting of a quartz tube ended with a boron nitride part presenting at its end a rectangular nozzle with the width of 0.5 . . . 0.8 mm and the length of 1 . . . 3 mm, depending on the dimensions of the ribbon to be realized. The crucible is placed in front of a copper disk with the diameter of 35 cm, rotating with a peripheral speed of 30 . . . 35 m/s, at a distance of 0.5 mm, to provide a uniform flow of the molten alloy. The crucible is introduced in an induction coil consisting of 5 turns of copper pipe, supplied by a medium frequency power generator, which ensures the melting of the alloy pieces previously extracted from the melted alloy. When the melted alloy is heated up to 1000 . . . 1400° C., at the upper part of the crucible an overpressure of argon gas of 0.15 . . . 0.22 bars is applied, which forces the liquid alloy to be ejected on the rotating disk, resulting in the formation of a metallic ribbon with the thickness ranging between 10 and 40 μm and width of 0.2 . . . 5 mm. In order to avoid the oxidation of the melted alloy, the copper disk—crucible system is placed in a high vacuum stainless steel chamber (minimum $10^{-4}$ mbar), after which argon or helium is introduced, the amorphous ribbon being obtained in a controlled atmosphere.

Procedure 2 to obtain the metallic magnetic material of Fe—Nb—B type with biocompatible elements shaped as glass-coated micro/nanowires through rapid quenching from the melt, according to the invention, consists in the fact that the alloy pieces weighing 3 . . . 4 g, extracted from the alloy according to the technique previously described in Procedure 1, is introduced in a Duran glass tube with the diameter of 12 mm and glass wall thickness of 1 mm, closed at the bottom and connected to a vacuum system at its upper part, placed in the centre of the induction coil supplied by a medium frequency power generator. The alloy heated to melting results in glass softening and is subsequently drawn at a controlled speed of 2500 . . . 3000 m/min on the collecting bobbin, resulting in the formation of a glass coated metallic wire with metallic core diameter of 80 . . . 950 nm and glass coating thickness of 5 . . . 6.5 μm. In order to obtain the glass coated micro/nanowires it is necessary to provide a vacuum level of 60 . . . 70 mm $H_2O$.

Procedure 3 to obtain the hereby metallic magnetic material of Fe—Nb—B type with biocompatible elements under the form of micro/nanopowders consists in mechanically milling the ribbons obtained through rapid quenching from the melt on a rotating metallic disk according to Procedure 1. The Fe—Ni—B ribbons with bio-compatible elements are subjected to preliminary thermal treatments in vacuum of $10^{-5}$ mbar and temperatures of 300 . . . 400° C., to diminish their hardness. The resulted ribbons are then cut in pieces of 3 . . . 5 mm and introduced in two milling vials of a planetary ball mill together with the milling balls in a ratio ball mass:milling material mass=50:1. In order to avoid powder contamination with other chemical elements, it is necessary that both the milling vials and the balls are made of hardened stainless steel. The ribbons are milled in a liquid medium in which the oleic acid and heptane represent 15 . . . 25 vol. % and 2 . . . 5 vol. %, respectively, of the amount of milled material, at a milling speed of 350 rpm with two-way rotation for 1 . . . 120 hours, the obtained powders having the sizes between 5 nm and 80 . . . 100 μm, depending on the milling time. The powders obtained in this way are washed at least five times in an ultrasound heptane bath, each washing lasting at least 5 min., to remove any trace of oleic acid. For their use in magnetic hyperthermia, the powders are additionally washed 5 times for 5 minutes in a solution of NaOH 10%, in an ultrasound bath. The resulted powders are dried in a vacuum oven for 2 hours at the temperature of 70° C.

Procedure 4 to obtain the hereby metallic magnetic material of Fe—Nb—B type with biocompatible elements shaped as nanopowders through arc discharge in inert gas atmosphere, consists in introducing a piece of alloy weighing 3 . . . 4 g, of the basic alloy according to the previously described Procedure 1, in a wolfram crucible, which represents one of the electrodes of the arc discharge, situated 4 . . . 5 mm apart from the second electrode, consisting of a wolfram rod. The whole system is placed in a sealed double-walled stainless steel chamber cooled with a liquid at the temperature of −10 . . . −15° C. After producing a vacuum of $2\times10^{-4}$ mbars in the chamber, 99.999% pure helium is introduced at a depression value of −0.2 . . . −0.95 bars compared to the atmospheric pressure. By applying a high frequency potential difference, the d.c. electric arc plasma is initiated between the two electrodes, with $I_{discharge}$=40 . . . 200 A, at a potential difference $U_{discharge}$=20 . . . 40 V, which determines the melting of the metal and then its conversion in vapors. The nanoparticles generated thereby are gathered after passivation in argon atmosphere in order to avoid its fast oxidation at the contact with the environment. By modifying the inert gas pressure during the discharge, the distance between electrodes and the discharge voltage within the described intervals, nanoparticles with dimensions ranging between 5 and 100 nm are obtained.

By applying the invention the following advantages can be obtained:

- obtain a metallic magnetic material with biocompatible elements and glassy quasi-amorphous structure, with the magnetic transition temperature ($T_C$) ranging between 0 . . . 70° C., depending on the concentration of the biocompatible element and the applications in which it is to be used;
- obtain a metallic magnetic material with biocompatible elements in various uni-dimensional (nanopowders, nanowires) and bidimensional (ribbons, microwires, micropowders) forms directly through the rapid quenching method, with high saturation magnetization, which has as result a fast, extremely rigorously controlled heating in the presence of a high frequency alternative magnetic field;
- improve the reproducibility and thermal stability of the metallic magnetic material with biocompatible elements and with $T_C$ within the interval 0 . . . 70° C. for utilization in medical applications, for instance in hyperthermia, namely allowing the local heating of a malign tumor when applying a high frequency alternative magnetic field at an optimum temperature value, namely the magnetic transition temperature, irrespective of the intensity of the applied magnetic field, ensuring a self-regulation of the desired temperature, which is not possible in the case of other magnetic materials;
- obtain a metallic magnetic material with biocompatible elements and controlled Curie temperature which, by its composition, shape, dimensions and specific magnetic characteristics, can be used to produce magnetic field sensors and to detect other mechanical parameters which depend on the magnetic field value, which can be blocked in operation at a certain environmental temperature.

Figure 2:
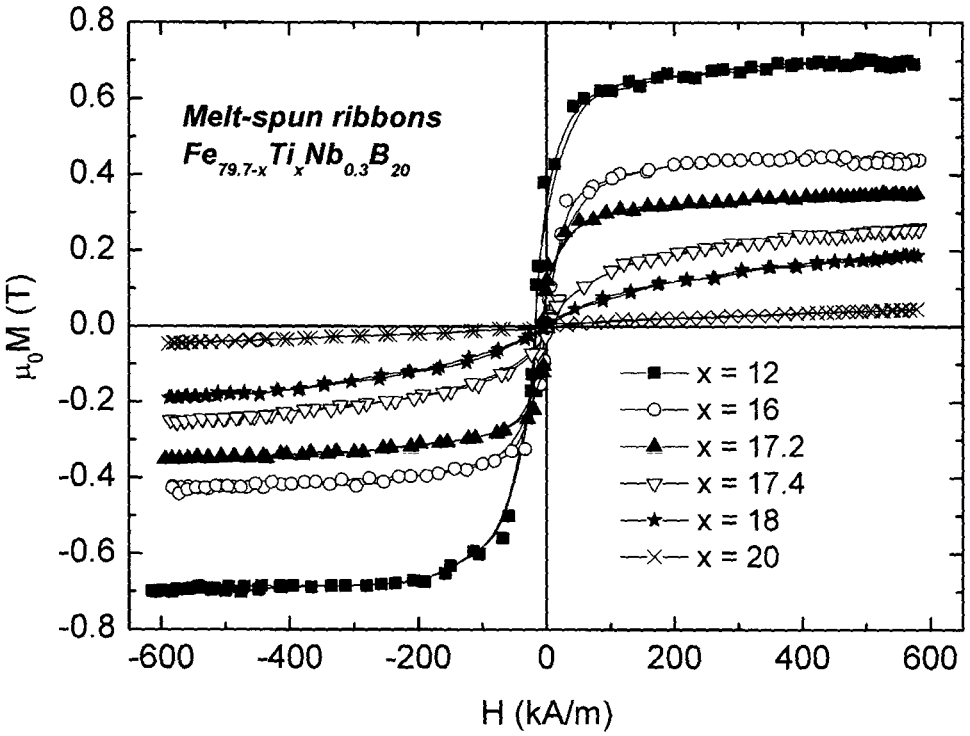
Figure 3:
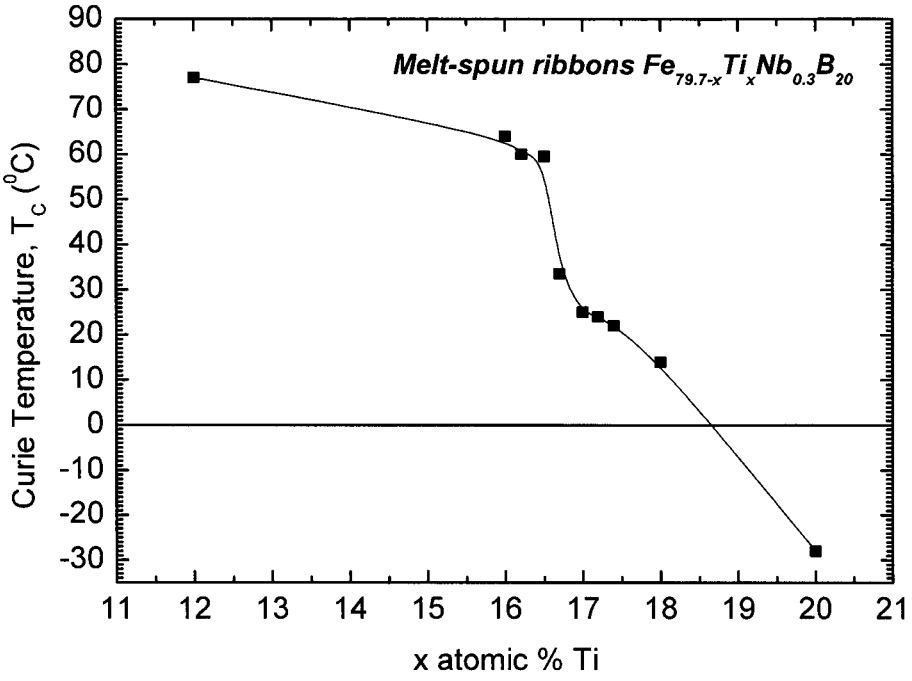
Figure 4:
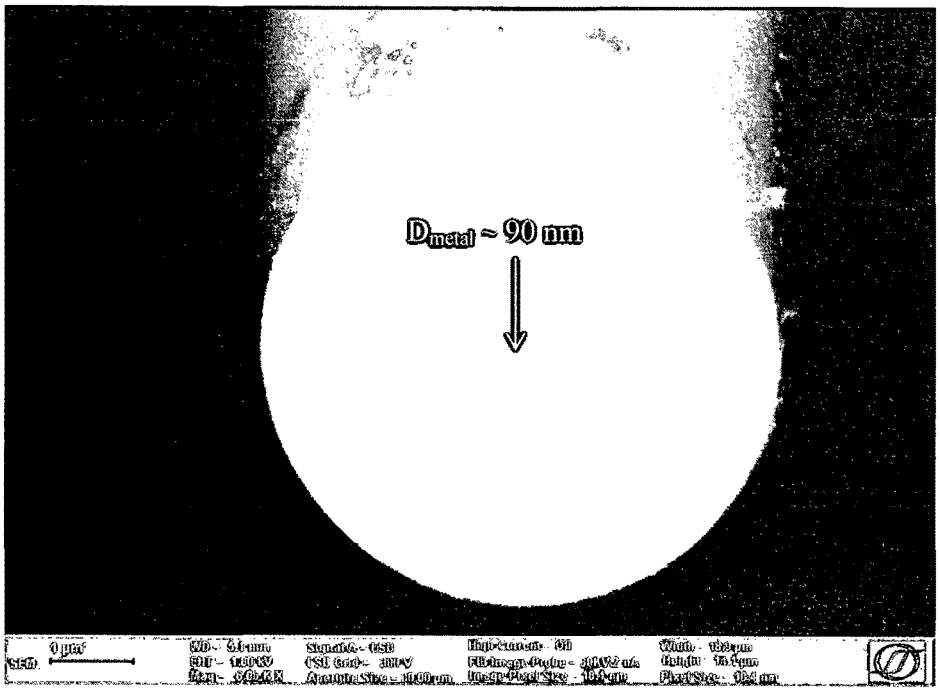
Figure 5:
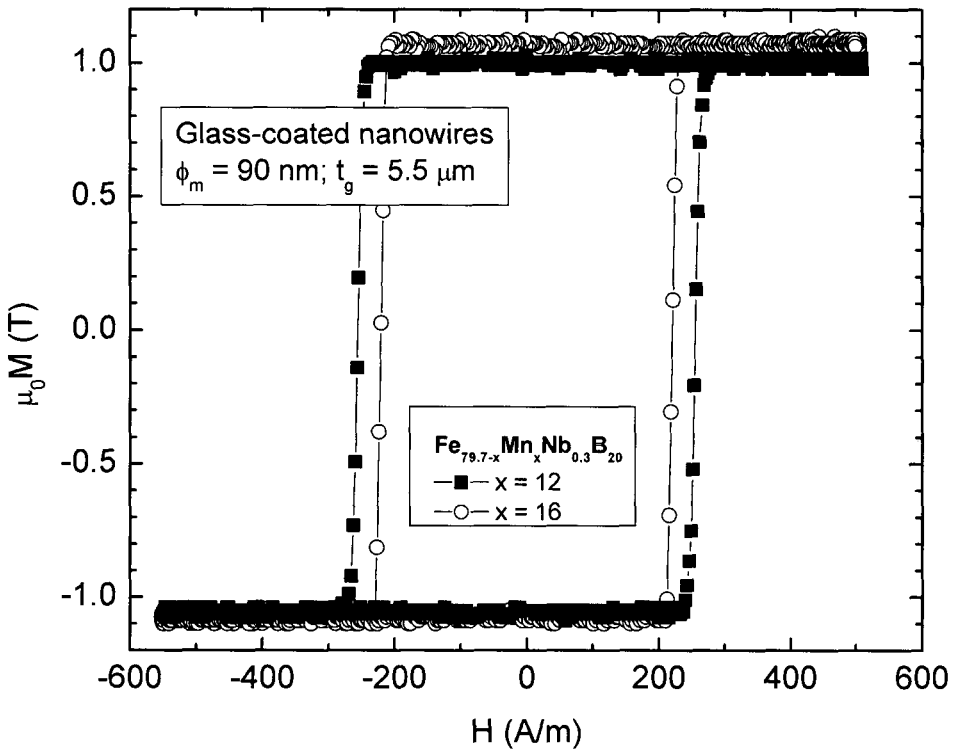
Figure 6:
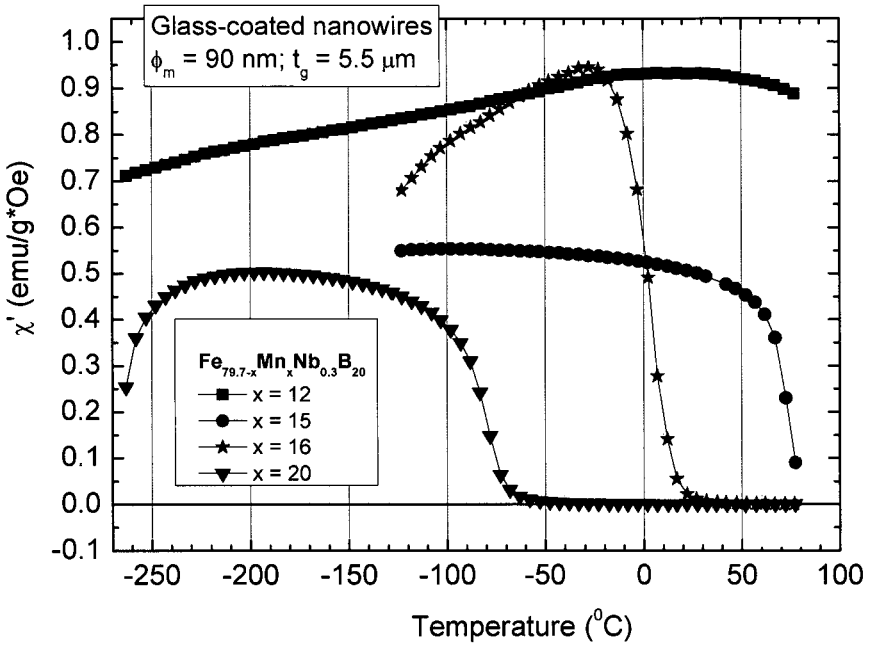
Figure 7:
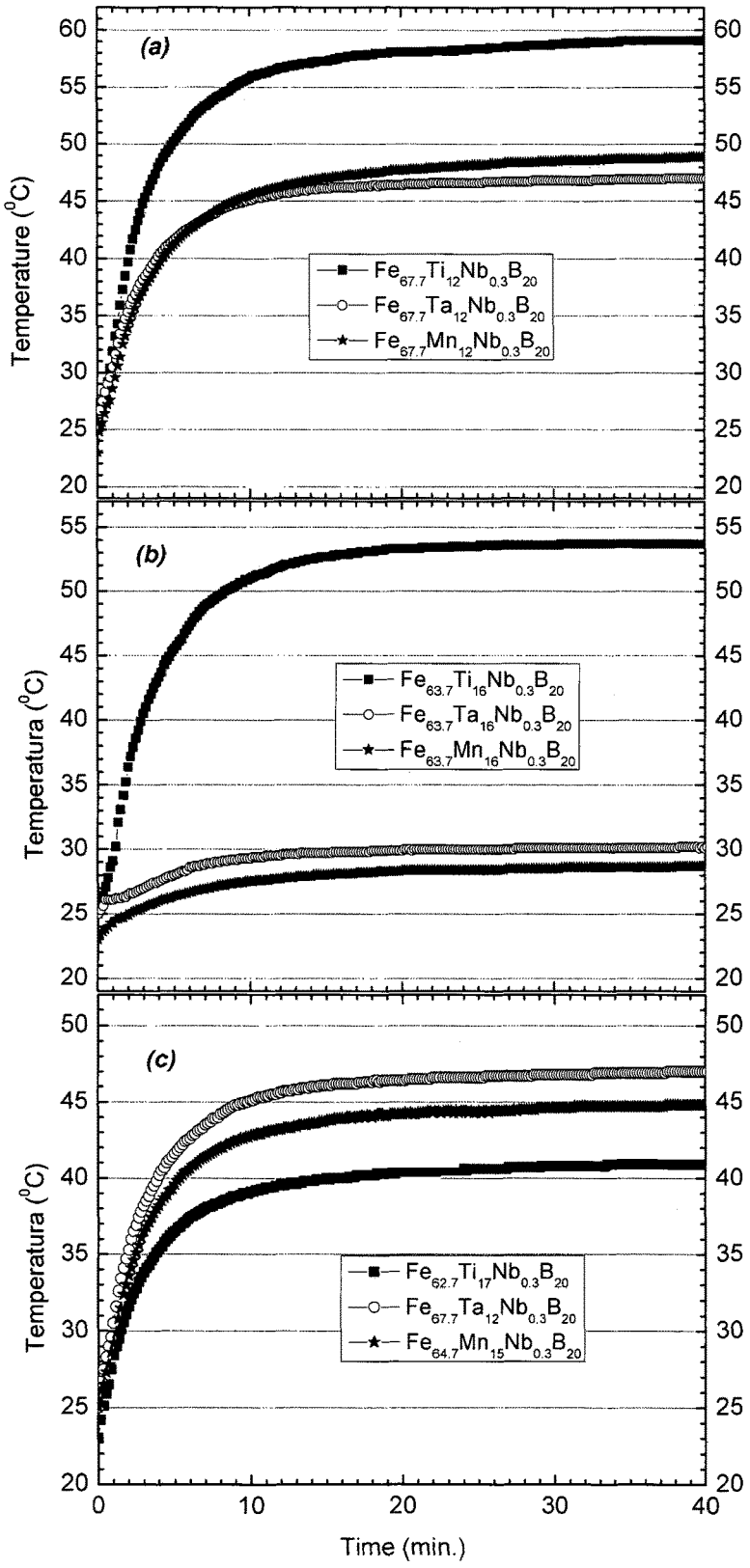

Three examples are given in the following related to FIGS. 1 . . . 7, which represent:

FIG. 1, X-ray diffraction patterns obtained for as-quenched ribbons with nominal compositions $Fe_{79.9-x}Ti_xNb_{0.3}B_{20}$, where x=12 . . . 20 at. %;

FIG. 2, Magnetic hysteresis loops for as-quenched ribbons with nominal compositions $Fe_{79.7-x}Ti_xNb_{0.3}B_{20}$, where x=12 . . . 20 at. %;

FIG. 3, Curie temperature variation vs. Ti content for as-quenched ribbons with nominal composition $Fe_{79.7-x}Ti_xNb_{0.3}B_{20}$, where x=12 . . . 20 at. %;

FIG. 4, SEM images of a glass-coated wire with the inner metallic diameter of 90 nm and glass coating thickness of 5.5 μm, with nominal composition $Fe_{64.7-x}Mn_{15}Nb_{0.3}B_{20}$;

FIG. 5, Magnetic hysteresis loops for as-quenched glass-coated nanowires with nominal compositions $Fe_{79.7-x}Mn_xNb_{0.3}B_{20}$, where x=12 and 16 at. %, with the inner metallic diameter of 90 nm and glass coating thickness $t_g$=5.5 μm;

FIG. 6, Variation of the real part of the magnetic susceptibility with temperature for as-quenched glass coated nanowires with nominal compositions $Fe_{79.7-x}Mn_xNb_{0.3}B_{20}$, where x=12 . . . 20 at. %, with the inner metallic diameter $\Phi_m$=90 nm and glass coating thickness $t_g$=5.5 μm;

FIG. 7, Equilibrium temperature vs. time for nanopowders of $Fe_{79.7-x}Ti_xNb_{0.3}B_{20}$, $Fe_{79.7-x}Ta_xNb_{0.3}B_{20}$ and $Fe_{79.7-x}Mn_xNb_{0.3}B_{20}$ respectively, where x=12 . . . 17 at. %, with sizes between 20 . . . 100 nm, obtained by milling ribbons with the same composition in oleic acid, in an alternative magnetic field, H=350 mT, and the frequency, f=153 kHz.

EXAMPLE 1

Procedure hereby consists in the preparation of an alloy of pure components, with nominal composition $Fe_{79.7-x}Ti_xNb_{0.3}B_{20}$, by inductive melting in a quartz tube sealed at the bottom, placed in a vacuum chamber. From the molten alloy one then extract, by means of a special system consisting of several quartz tubes, pieces of alloy of 3 . . . 4 g each to provide a good homogeneity of the alloy and an adequate shape for its subsequent use for producing metallic ribbons by rapid quenching from the melt. The alloy piece of 3 . . . 4 g is then introduced in a quartz tube ended at its bottom with a boron nitride part, which has at its end a rectangular nozzle with the length of 0.5 mm and width of 3 mm. This crucible is placed in front of a copper disc with the diameter of 36 cm, rotating with a peripheral speed of 30 m/s, at a distance of 0.5 mm, in order to provide a uniform flow of the molten alloy. The crucible is introduced in an induction coil consisting of 5 turns of copper pipe, supplied by a medium frequency power generator, which provides re-melting of the piece of alloy previously extracted from the molten alloy. When the alloy is melted and heated at 1200±50° C., an overpressure of argon gas of 0.15 bar is introduced at the upper part of the crucible, which forces the liquid alloy to be ejected on the rotating disc, thus resulting in the formation of a metallic melt-spun ribbon with the thickness of 15 . . . 20 μm and widths of 0.4 . . . 0.5 mm. In order to avoid the oxidation of the molten alloy, the copper disc—crucible system is placed inside a vacuum chamber (at least $10^{-4}$ mbar), after which argon or helium is introduced, the ribbon being obtained in a controlled atmosphere.

The melt-spun ribbons obtained hereby present a quasi-amorphous structure, as in FIG. 1, consisting in atoms agglomerations (clusters) with the size of 2 . . . 6 nm, specific to the "glassy metals" materials, irrespective of the Ti content. This specific microstructure confers the Fe—Nb—B metallic material a ferromagnetic behavior with the following characteristics:

- saturation magnetic induction, $\mu_o M_s$ of 0.05 . . . 0.07 T, depending on the Ti content, as in FIG. 2;
- coercive field $H_c$ of 100 . . . 300 Oe, depending on Ti content, as in FIG. 2;
- Curie temperature, $T_C$ of −30 . . . 78° C., depending on Ti content, as in FIG. 3.

The Curie temperature $T_C$ of 20 . . . 70° C. of interest for the Fe—Nb—Ti—B ribbons, according to the invention, are obtained for concentrations of Ti from 18 to 16 at. %, as in FIG. 3, for which the values of the saturation magnetic induction also range between 0.2 and 0.45 T, according to magnetic hysteresis loops from FIG. 2. These ribbons with "glassy"-type quasi-amorphous structure can be used directly in magnetic field sensors to determine other physical parameters which depend on the magnetic field, sensors whose operation is blocked at a certain temperature, according to the invention.

EXAMPLE 2

The process hereby consists in the preparation of glass-coated nano/microwires with nominal composition $Fe_{79.7-x}Mn_xNb_{0.3}B_{20}$, where x=12 . . . 20 at. %. The basic alloy is prepared from pure elements through magnetic induction in a quartz tube sealed at the bottom, placed inside a vacuum chamber. Pieces of 3÷4 g are extracted from this alloy according to the description from Example 1, then introduced in a Duran glass pipe with the diameter of 12 mm and wall thickness of 1 mm, sealed at its bottom and connected at its upper part to a vacuum system, placed inside an induction coil supplied by a medium frequency power generator. The alloy inductively heated up to the melting temperature $T_{melt}$=1100° C.±50° C. produces glass softening and is initially drawn manually to initiate the process, and then automatically with a controlled speed of 3000±150 m/min., on a collecting bobbin located in air, thus resulting a glass-coated metallic wire with the metallic inner diameter of about 90 nm and glass coating thickness of 5.5 μm, as in FIG. 4. In order to avoid the oxidation of the melted alloy and to draw the metallic wire into the glass, a vacuum of 60 . . . 70 mm $H_2O$ in ensured.

The glass coated nanowires with nominal composition $Fe_{79.7-x}Mn_xNb_{0.3}B_{20}$, where x=12 . . . 20 at. %, obtained hereby, preserve the quasi-amorphous structure as in the case of ribbons presented in the Example 1; they present a magnetic saturation induction of 1 . . . 1.1 T depending on the Mn content, as in FIG. 5, and relative magnetic permeability of 3500 . . . 4000. Their magnetic transition temperature $T_C$ significantly changes with the Mn content for the glass-coated nanowires, from −70° C. to over 70° C., as in FIG. 6, thus covering the temperature interval of 20 . . . 70° C., according to the invention. These glass-coated nanowires hereby can be used in the realization of magnetic field sensors within a well-established operation range, such as the sensors which can get blocked at temperatures lower or equal with the transition temperature, $T_C$. This kind of nanowires can be also used in the process of cancer cell destruction through hyperthermia, by automatically maintaining the temperature at a value equal to $T_C$.

EXAMPLE 3

Process hereby consists in obtaining a metallic magnetic material of Fe—Nb—B type with biocompatible (Ti, Ta, Mn) elements under the form of micro/nanopowders through milling in a liquid medium, from the ribbons obtained through rapid quenching from the melt as in Example 1. The obtained powders must preserve the quasi-amorphous structure existing in the obtained ribbons as in Example 1, in order to have the magnetic transition temperature ($T_C$) within the interval 20 . . . 70° C., according to the invention. That is why the milling process that implies dissipation of energies and local high temperatures induced by the friction process must be controlled very strictly. According to the invention, the Fe—Nb—B ribbons with biocompatible elements (Ti, Ta, Mn) are subjected to a preliminary thermal treatment at a temperature of 400° C., in a vacuum of $10^{-5}$ mbar, in order to diminish the hardness and to increase the brittleness. The annealed ribbons are cut in pieces of 3-5 mm and introduced in two vials of hardened stainless steel, together with the balls made of the same material at a mass ratio balls:milling material=50:1, oleic acid 18 vol. % and heptane 2.7 vol. %. The two planetary two-ways ball mills are rotating with a speed of 550 rpm. The $Fe_{79.7-x}Ti_xNb_{0.3}B_{20}$ powders (where x=12 . . . 20 at. %), with average size of 20 . . . 60 nm, are obtained by milling the ribbons for 3 hours, while for the powders of $Fe_{79.7-x}Ta_xNb_{0.3}B_{20}$, with x=12 . . . 20 at % a milling time of 13 hours is necessary to obtain similar dimensions. In the case of $Fe_{79.7-x}Mn_xNb_{0.3}B_{20}$, where x=12-20 at. %, the milling time was 26 h, and the average powder dimensions range between 40 . . . 100 nm, depending on the Mn content. The powders obtained in this way are washed at least 5 times with heptane to remove the traces of oleic acid in ultrasound bath, each washing operation lasting at least 5 minutes. For their use in hyperthermia, the powders are additionally washed in a solution of NaOH 10% in ultrasound bath for at least 5 minutes, the operation being repeated 5 times. Powders are then dried for 2 h in a vacuum oven at 70° C. The tests for plotting the variation in time of the temperature of thermal equilibrium presented in FIG. 7 were carried out in an experimental set-up especially designed for hyperthermia, in the presence of an alternative magnetic field with H=350 mT and the frequency f=153 kHz. An amount of 10 mg powder is introduced in a double-walled glass vessel voided inside for a better thermal isolation, with a volume V=0.13 ml of $H_2O$, the mixture being induction heated by means of a high frequency generator. By controlling the Ti, Ta or Mn content, one can obtain equilibrium temperatures useful for hyperthermia (between 40° C. and 47-48° C.), like in FIG. 7(*c*), which is maintained irrespective of the heat duration and the value of the induction coil heating power. In this way one can realize, according to the invention, the self-control of the heating temperature in the case of hyperthermia, according to the necessities of the cancer cells destruction process.

REFERENCES

[1] R. M. Bozorth, *Ferromagnetism*, Wiley-IEEE Press, 1993.

[2] T. Kaneyoshi, *Introduction to Amorphous Magnets*, World Scientific Publishing, 1992.

[3] V. Zhukova, S. Kaloshkin, A. Zhukov, J. Gonzalez, *Journal of Magnetism and Magnetic Materials* 249(1-2) (2002) p. 108-112.

[4] V. Zhukova, J. M. Blanco, M. Ipatov, A. Zhukov, C. Garcia, J. Gonzalez, R. Varga, A. Torcunov, *Sensors and Actuators B* 126 (2007) p. 318-323.

[5] J. Stergar, G. Ferk, I. Ban, M. Drofenik, A. Hamler, M. Jagodič, D. Makovec, *Journal of Alloys and Compounds* 576 (2013) P. 220-226.

[6] D. S. Choi, J. Park, S. Kim, D. H. Gracias, M. K. Cho, Y. K. Kim, A. Fung, S. E. Lee, Y. Chen, S. Khanal, S. Baral, J.-H. Kim, *Journal of Nanoscience and Nanotechnology* 8(5) (2008), p 2323-2327.

[7] N. Lupu, H. Chiriac, S. Corodeanu, G. Ababei, *IEEE Transactions on Magnetics* 47(10) (2011) p. 3791-3794.

The invention claimed is:

1. Fe—Nb—B-based metallic magnetic material for use in magnetic sensors based on magnetic permeability variation and for hyperthermia applications, having the composition $Fe_{79.7-x}Ti_xNb_{0.3}B_{20}$, where M is a biocompatible material chosen from Ti, Ta and Mn, and x=12 to 20 at %, with "glassy" quasi-amorphous structure, obtained under the form of ribbons, micro/nanowires and micro/nanopowders, the concentration of the biocompatible material being chosen such that the magnetic transition temperature Tc ranges between 0° C. and 70° C., the saturation magnetic induction is between 0.05 and 1.1 T, and the relative magnetic permeability is 3500-4000, and presenting a significant variation of over 90% of the magnetic permeability/susceptibility in the proximity of the magnetic transition temperature.

2. A process to obtain Fe—Nb—B-based metallic magnetic material with biocompatible elements, according to claim 1, under the form of metallic ribbons with a thickness of 10-40 μm, width of 0.2-5 mm and specific quasi-amorphous "glassy" structure, comprising:

a first step of obtaining a metallic alloy from pure components within a vacuum chamber;

a second step of extracting pieces of 3-4 g each, from the metallic alloy;

a third step of introducing the pieces extracted in the second step in the amorphizing crucible ended with a piece of boron nitride, which has at its end a rectangular nozzle with a width of 0.5-0.8 mm and a length of 1-3 mm, depending on the desired size of the ribbon to be produced, which is placed inside an induction coil consisting of 5 turns of copper pipe, supplied by a frequency power generator, in a vacuum of a minimum 104 mbar or in He or Ar atmosphere, through the application of an Ar overpressure of 0.15-0.22 bars and melting the alloy pieces previously extracted; and a fourth step of ejecting the molten alloy on a copper disc with a diameter of 36 cm, rotating with a peripheral speed of 30-35 m/s, at a distance of 0.5 mm from the lower margin of the boron nitride nozzle, in order to provide a uniform flow of the molten alloy.

3. A process to obtain Fe—Nb—B-based metallic magnetic material with biocompatible elements, according to claim 1, under the form of glass-coated micro/nanowires with metallic core diameters of 80-950 nm and glass coating thickness of 5-6.5 μm, with specific quasi-amorphous "glassy" structure, comprising:

a first step of obtaining a metallic alloy from pure components within a vacuum chamber;

a second step of extracting pieces of 3-4 g each, from the metallic alloy;

a third step of heating to melting the alloy in a Duran glass pipe with a diameter of 12 mm and glass wall thickness of 1 mm, sealed at a bottom and connected at its upper part to a vacuum system with a 60-70 mm $H_2O$ vacuum in the glass tube, placed inside an induction coil supplied by a frequency power generator, in order to produce glass softening; and a fourth step of drawing the molten alloy from the third step at a speed of 2500-3000 m/min. on a collecting bobbin, resulting in the production of a glass-coated metallic nano/microwire.

4. The process to obtain Fe—Nb—B-based metallic magnetic material with biocompatible elements under the form of nano/micropowders with dimensions comprised between 5 nm and 80-100 μm, comprising the process to obtain the ribbons according to claim 2, and further comprising:

a fifth step of treating of the ribbons in a vacuum of $10^{-5}$ mbar at temperatures of 300-400° C. to diminish the ribbon hardness;

a sixth step of mechanical milling of the ribbons obtained in the fifth step, resulting in the fragmentation of the treated ribbons in pieces of 3-5 mm each by introducing into two hardened stainless steel milling vials of a planetary ball mill together with the balls, in a mass ratio balls:material=50:1, the milling being performed in a liquid medium in which the oleic acid and heptane represent 15-20 vol. % and 2-5 vol. %, respectively, from the quantity of milled material, at a rotation speed of the milling vials of 550 rpm, with a two-way rotation, for 1-120 hours;

a seventh step of washing the powders from the sixth step at least five times with heptane in an ultrasound bath to remove the oleic acid traces; and an eighth step of drying the powders from the seventh step in vacuum oven for 2 h at the temperature of 70° C., and the powders have the same quasi-amorphous structure as that existing in the ribbons obtained and magnetic properties.

5. Fe—Nb—B-based metallic magnetic material for use in magnetic sensors based on magnetic permeability variation and for hyperthermia applications, having the composition $Fe_{79.7-x}Ti_xNb_{0.3}B_{20}$, where M is a biocompatible material chosen from Ti, Ta and Mn, and x=12 to 20 at %, with "glassy" quasi-amorphous structure, obtained under the form of ribbons and micro/nanopowders, the concentration of the biocompatible material being chosen such that the magnetic transition temperature Tc ranges between 0° C. and 70° C., the saturation magnetic induction is between 0.05 and 1.1 T, and the relative magnetic permeability is 3500-4000, and presenting a significant variation of over 90% of the magnetic permeability/susceptibility in the proximity of the magnetic transition temperature, under the form of metallic ribbons with a thickness of 10-40 μm, width of 0.2-5 mm and specific quasi-amorphous "glassy" structure, obtained by a process comprising:

a first step of obtaining a metallic alloy from pure components within a vacuum chamber;

a second step of extracting pieces of 3-4 g each, from the metallic alloy;

a third step of introducing the pieces extracted in the second step in the amorphizing crucible ended with a piece of boron nitride, which has at its end a rectangular nozzle with the width of 0.5-0.8 mm and the length of 1-3 mm, depending on a wanted size of the ribbon to be produced, which is placed inside an induction coil consisting of 5 turns of copper pipe, supplied by a medium frequency power generator, in a vacuum of minimum $10^{-4}$ mbar or in He or Ar atmosphere, through the application of an Ar overpressure of 0.15-0.22 bars, melting the alloy pieces previously extracted;

a fourth step of ejecting the molten alloy on a copper disc with the diameter of 36 cm, rotating with a peripheral speed of 30-35 m/s, at a distance of 0.5 mm from the lower margin of the boron nitride nozzle, in order to provide a uniform flow of the molten alloy;

and under the form of nano/micropowders with dimensions comprised between 5 nm and 80-100 μm, by the process further comprising:

a fifth step of treatment of the ribbons obtained in the fourth step in a vacuum of $10^{-5}$ mbar at temperatures of 300-400° C. to diminish their hardness;

a sixth step of mechanical milling the ribbons, resulting the fragmentation of treated ribbons in pieces of 3-5 mm each by introduction in two hardened stainless steel milling vials of a planetary ball mill together with the balls, in a mass ratio balls:material=50:1, the milling being performed in a liquid medium in which oleic acid and heptane represent 15-20 vol. % and 2-5 vol. %, respectively, from the quantity of milled material, at a rotation speed of the milling vials of 550 rpm, with a two-way rotation, for 1-120 hours, obtaining powders having the sizes between 5 nm and 80-100 μm;

a seventh step of washing the powders at least five times with heptane in an ultrasound bath to remove some traces of the oleic acid; and an eighth step of drying the powders in vacuum oven for 2 h at a temperature of 70° C., and the powders having the same quasi-amorphous structure as that existing in the ribbons.

6. The process to obtain Fe—Nb—B-based metallic magnetic material with biocompatible elements according to claim 4, wherein the ribbons obtain magnetic properties.

* * * * *